US008356818B2

(12) United States Patent
Mraz

(10) Patent No.: US 8,356,818 B2
(45) Date of Patent: Jan. 22, 2013

(54) DURABLE TARGET APPARATUS AND METHOD OF ON-TARGET VISUAL DISPLAY

(75) Inventor: Rocky Mraz, Auburn, CA (US)

(73) Assignee: Real-Time Targets, LLC, Story, WY (US)

( * ) Notice: Subject to any disclaimer, the term of this patent is extended or adjusted under 35 U.S.C. 154(b) by 991 days.

(21) Appl. No.: 12/191,296

(22) Filed: Aug. 13, 2008

(65) Prior Publication Data

US 2010/0038854 A1 Feb. 18, 2010

(51) Int. Cl.
*F41J 5/04* (2006.01)
*F41J 5/14* (2006.01)

(52) U.S. Cl. ..... 273/371; 273/348; 273/378

(58) Field of Classification Search ..... 273/348, 273/371, 373, 378–379, 408; 463/49, 51–52; 235/400, 411

See application file for complete search history.

(56) References Cited

U.S. PATENT DOCUMENTS

| | | | | |
|---|---|---|---|---|
| 815,117 | A | 3/1906 | Peters | |
| 1,260,691 | A | 3/1918 | McGregor | |
| 2,934,346 | A | 4/1960 | Mongello | |
| 2,939,706 | A | 6/1960 | Skaredoff | |
| 3,677,546 | A * | 7/1972 | Oetiker | 273/374 |
| 3,678,495 | A | 7/1972 | Gilbert | |
| 4,303,853 | A * | 12/1981 | Thalmann | 235/400 |
| 4,305,142 | A | 12/1981 | Springer | |
| 5,195,433 | A | 3/1993 | Krumenacker et al. | |
| 5,447,315 | A | 9/1995 | Perkins | |
| 5,676,548 | A | 10/1997 | McAlpin et al. | |
| 5,908,194 | A | 6/1999 | Schachter et al. | |
| 5,988,645 | A * | 11/1999 | Downing | 273/348 |
| 6,293,869 | B1 * | 9/2001 | Kwan et al. | 463/51 |
| 6,367,800 | B1 | 4/2002 | Sheck et al. | |
| 6,734,833 | B1 | 5/2004 | Bartosik | |
| 7,100,922 | B2 | 9/2006 | Maeda et al. | |
| 2006/0151957 | A1 * | 7/2006 | Pan et al. | 273/404 |
| 2007/0001400 | A1 | 1/2007 | Stewart | |

FOREIGN PATENT DOCUMENTS

CH EP 1139058 10/2001

* cited by examiner

*Primary Examiner* — Dmitry Suhol
*Assistant Examiner* — Alex F. R. P. Rada, II
(74) *Attorney, Agent, or Firm* — Antoinette M. Tease

(57) ABSTRACT

A durable reusable target apparatus with on-target visual display is described. In embodiments of the invention, pie-shaped target sectors surround a bull's eye sector. Each sector may be associated with one or more illuminated display segments. The display segments are visible at a distance, enabling shooters to determine the sector hit, and to adjust a next shot without looking away, thereby improving shooter proficiency. Various training mode are available. Methods for determining the target sector impacted and algorithms for asserting the correct display segment(s) are described. By utilizing on-target display segments, embodiments of the invention enable the shooter to ascertain the accuracy of the shot without looking away from the sights on the firearm or from the target.

21 Claims, 10 Drawing Sheets

DURABLE TARGET APPARATUS AND METHOD OF ON-TARGET VISUAL DISPLAY

BACKGROUND OF THE INVENTION

1. Field of the Invention

Embodiments of the invention described herein pertain to the field of targets. More particularly, but not by way of limitation, one or more embodiments of the invention enable a durable target apparatus and method of on-target visual display in which a shooter is presented with an on-target representation of the approximate location of a point of impact of a bullet fired by the shooter. In one or more embodiments of the invention, the shooter receives immediate visual feedback for each shot without requiring the shooter to look away from the target.

2. Description of the Related Art

Traditionally, shooters who participate in target practice are unable to see the point of impact of the bullet on a typical non-durable paper target downrange because of the small diameter of the bullet hole on the target. At a typical target practice session, shooters take one or more shots at a target, and then periodically set down the firearm and view the target through a spotting scope, or alternatively, make their weapon safe and physically approach the target. The shooter then attempts to correlate the marks on the target with previous shots. Occasionally, a bullet leaves no additional hole in the target, for example, when the bullet passes through a hole previously made by another bullet that has already passed through the target. Not only is this approach to determining shot location time consuming, shooters have difficulty improving because they do not receive immediate feedback for every shot and in many cases are unsure as to which shot has produced which hole.

Improved paper targets exist which "splatter" or "flake" to provide an enlarged area about the hole in the target where the bullet has passed. There are also targets that show a different color around the bullet hole in the target, some of which are fluorescent for example. These targets attempt to provide on-target visual feedback directly on the target that is more visible than a hole in a non-splatter target. These targets still are problematic in that a shot through an existing hole in a target with two or more shots through it already provides no feedback to the user as to which hole the shot passed through. In addition, these targets are non-durable, for example penetrable, so must be purchased and replaced, cannot be printed out directly by a shooter on his or her own printer, and must be patched to cover the holes with the same type of material that splatters or flakes.

Mechanical targets exist that simply allow a shooter to know if the target was hit or not. In other words, there is no indication as to which side of the target or how far from the bull's eye a shot has hit. For example, some mechanical targets move when hit by a bullet and present, for example, a different colored target. This type of target is used in the biathlon, for example. Other mechanical based targets simply fall over when hit. Alternatively, a silhouette target makes a loud noise when hit. In addition, mechanical targets generally require some type of action to replace the target to its original position. One method for restoring the position of the target is to shoot a target that is mechanically attached to the other targets that have fallen, which provides mechanical energy that pushes the target back to its vertical orientation.

To provide immediate feedback to competitors in shooting matches, systems have been developed that display the exact shot location to the shooter after each shot, generally by employing a television to show the exact location of the shot displayed on a nearby television monitor. However, these systems require shooters to take their eyes off the sights or target to view the last shot location displayed on the nearby monitor. This approach prevents shooters from immediately critiquing their shot because they need to take their eyes away from their sights to view the television monitor. For example, in an Olympic "standard pistol" timed or rapid-fire stage, five shots are fired within 20 seconds or 10 seconds for example. It is impossible to put the firearm down and check each shot displayed on the monitor as each shot occurs in the time limit allotted.

Other systems exist that detect shot impacts on a target using sensors mounted behind the target. A combination of very complex equations is solved to triangulate the approximate location of the shot and many of these systems must be tuned to type of bullet being shot. For example, some systems require thicker metal for various bullet calibers so that the impact of the bullet is only detected by a single impact sensor, or minimal number of impact sensors mounted on the rear of the target. By using thicker metal, or stronger springs in the impact sensors, or high gas compression in the sensors, the number of sensors that register a shot can be kept to one or two for example. For these systems, if a shot is directly in between two sensors, two lights may be presented causing confusion. Complex arbitration logic is then required to only display one light. In addition, these systems generally present lights or a score on a board of display that looks like a target, but do not present lights directly on or about the target to minimize the time and angle that a shooter looks away from the actual target. Hence, these systems are not suitable for "action" shooting, moving target practice, timed or rapid fire shooting. Some systems require carved grooves in the rear portion of the target as well to limit the sensors that trigger when an impact from a bullet occurs. This requires extra manufacturing steps and provides areas on the target that can break if not properly curved, for example. Other systems drill holes in the back of the target which increases costs and in mentioned. Still other systems utilize complex circuitry to clock the differences in time between sensor triggers to calculate exact locations of the shot impact.

It would be desirable to have a firearm targeting system that could provide a plurality of modes, such as high-low training and/or left-right training and/or sector and bull's eye based training wherein the feedback to the shooter is presented immediately on-target, downrange from the shooter. It would also be an advantage to have a firearm targeting system that employs a simple sensor network and hardened target plate that can be used for all calibers of bullets. Furthermore, it would be an advantage to have a firearm targeting system that could prompt a shooter to shoot at a sequence of targets and provide immediate feedback of success directly on the target. Furthermore, it would be an advantage to have a moving target system that provides feedback of success directly on the target and visible downrange of the shooter, without requiring the shooter to look away from the target. For at least the limitations described above there is a need for a durable target apparatus and method of on-target visual feedback display that enable shooters receive immediate feedback of each shot without requiring the shooter to look away from the sights on the firearm or target.

BRIEF SUMMARY OF THE INVENTION

One or more embodiments of the invention enable a durable target apparatus and method of on-target visual display. In various embodiments of the invention, pie-shaped target sectors surround a bull's eye sector. However, target sectors, if seen on the face of the target at all, may form a circle, octagon, square, rectangle or any other geometric shape. Each sector may be associated with one or more illuminated display segments. The display segments are visible at a distance, enabling shooters to determine the sector hit, and to adjust a next shot without looking away from the target, thereby improving shooter proficiency. Various training mode are available. Methods for determining the target sector impacted and algorithms for asserting the correct display segment(s) are described. By utilizing on-target display segments, embodiments of the invention enable a shooter to ascertain the accuracy of the shot without looking away from the sights on the firearm or from the target.

The target apparatus of the invention is configured to be durable. In a preferred embodiment, the target apparatus is impenetrable to bullets of any caliber by providing a target plate thick and strong enough to deny passage of a bullet through the apparatus. Thus, the apparatus does not have to be replaced as paper targets do, therein lowering long term shooting costs. A target surface durable enough to withstand repeated shot impacts, for example a surface with a Brinell hardness of about 400 or higher, may also be supported with a dampening material, such as polyurethane or Styrofoam, coupled to the reverse side of the target surface to slow down the impact shock wave and allow iterative scanning by sensors designed to locate the impact of the shot on the target.

One or more embodiments of the invention provide on-target display segments to enable shooters to determine the approximate location of a hit on the target quickly. While display segments are described herein as "display lights," one or more embodiments may use alternative methods of indicating the target sector that was hit by the shot. For example, the color of the target sector itself might be changed. Any other method of indicating the impacted sector known in the art and visible downrange by the shooter is within the scope of the invention. In preferred embodiments, the display segments are display lights that are within the shooter's field of view as the shooter aims at the target, therein providing immediate feedback as to the accuracy of the shot. In one or more embodiments of the invention, several pie-shaped wedges or target sectors surround a "bull's eye" at the center of the target. Display segments may be located on or near the target sectors, and in some embodiments may be located in or near the bull's eye itself, placing the feedback clearly within the shooter's field of view and clearly visible from an appropriate distance. In addition, use of on-target display segments enables embodiments of the invention to indicate the approximate location of the hit on the target without requiring the shooter to look away from the sights of the firearm or away from the target itself, allowing the shooter to set up the next shot without changing stance, which may be an improvement over some prior targets. This is particularly helpful for training when shooting targets at long distances where one cannot see an impact location of the bullet, for example on a conventional paper target.

Various embodiments of the invention may be computerized. Computerized embodiments may utilize a simple impact-location algorithm to determine the area of the impact on the target by identifying the first impact sensor to register an impact. The hit is then visually represented on-target with visual indicators such as illuminated lights in one or more embodiments of the invention. The present invention avoids the need for complex triangulation algorithms or arbitration schemes since the impact sensors may be scanned in order at high rates so that only one impact sensor is designated as the impact-associated sensor. In addition, multiple modes of operation or "games" may be played using the invention that require a display to show the approximate hit location, such as high-low, left-right, timing or other prompts and hit representations. These various modes of operation or games support varied training scenarios intended to improve the proficiency of the shooter. Other modes may be provided for entertainment only. Multiple embodiments of the invention may be networked together to provide shooting practice at a sequence of targets where targets at different locations prompt the shooter one after the other. In addition, targets of various embodiments may be mounted on tracks to provide running boar or moving targets for more challenging shooting practice. Other embodiments may provide a replaceable and variable sized bull's eye target sector to be substituted into the apparatus to challenge shooters of various skill levels.

Target sectors of the invention may be individual physical components or may be demarcations on the target surface. The target sectors should be at least strong enough to stop a bullet of the desired energy level, while allowing the sensors to determine the location of the impact force from the bullet. Target sectors may also be "virtual" in various embodiments, such that the sectors may be painted on or otherwise indicated the surface without being individual physical components. In other embodiments, the target sectors may not be visually displayed at all. For example, the entire target surface may be implemented as a solid circle with no sector line indicators in one or more of the triangulation embodiments, though the controller may still associate the approximate impact location with a display segment and illuminate the segment if desired. As long as the desired number of display segments are located in association with the desired number of target sectors (whether virtual or physical) and the bull's eye, various embodiments of the invention will be capable of displaying visual indications of the hit location on the target apparatus.

In one or more embodiments, the bull's eye target sector may be implemented as a detachable plug-shaped circular sector. In these embodiments, the bull's eye sector may be interchangeable with various sized circular sectors to allow for the desired training. In embodiments with a circular bull's eye sector that is implemented as an interchangeable plug that may be inserted into the bull's eye instead of an opening, the outer display segments may all be programmed to flash on and off a configurable number of times, or for a given number of seconds, to indicate a bull's eye impact. Any other method of indirectly indicating a bull's eye impact using illuminated on-target display segments is in keeping with the spirit of the invention. This type of shot location display is but one mode of operation or game that may be played with embodiments of the invention as discussed further below.

In one or more embodiments, the target apparatus includes sensors on or near the target that are configured to detect the impact of a bullet on the target and send one or more signals to a controller. In some embodiments, sensors may be aligned in sectors around the bull's eye of the target apparatus. Shot impact may be determined by feedback from the sensors associated with each target sector, and in one embodiment, the controller may associate the first sensor signal detected with the target sector location of the shot impact. Alternatively, triangulation techniques may be utilized to support a smaller number of sensors. In either embodiment, the controller then determines or calculates the location on the target of the bullet's impact. The controller may then illuminate one or more of the display segments so that the shooter can visually determine if the bullet impacted one of the target sectors or the bull's eye without looking away from the target apparatus. Hence, the invention provides an advance over traditional systems where a shooter is required to set down their firearm and attempt to determine the accuracy of their shots through a spotting scope. The reason this is an advance in the art is, for example, if a right-handed shooter "jerks" the trigger during a shot, the bullet may strike the left portion of the target, say at the "nine o'clock" position. Using the target apparatus of one or more embodiments of the invention, the target apparatus will illuminate the display segment associated with the leftmost target sector. The shooter may then make appropriate adjustments without moving his or her eye, hand or stance. Thus, shooters using the target of the invention may improve faster and more effectively because the invention provides immediate feedback without requiring the shooter to look away from the sights on the firearm or away from the target itself. After a configurable amount of time, the display segment associated with the shot impact is illuminated and then turned off. In one or more embodiments of the invention, the time may be set to be longer than the time a shooter requires to recover from the recoil of the shot.

Display segments may be implemented with light emitting diodes, for example. In one or more embodiments, the display segments may be covered with a bulletproof component. Display segments may also include a recessed area, for example, to protect the light component from direct impact from the bullet or projectile. In one or more embodiments, the recessed area may project light for example from a lateral direction that reflects off of angled metal for example that is directed towards the shooter. In one or more embodiments of the invention, display segments may be placed on an outer perimeter near each of the target sectors. Any number of target sectors may be used.

Embodiments of the invention allow for other modes of training besides shot location feedback as previously described. For example, two target sectors (or two sets of grouped target sectors) may be utilized to train for left-right training, or high-low training to indicate which half of the target a shot strikes. This enables a shooter to improve vertical and horizontal control independently for example. For example, if a shot is high and the outside bull's eye, but within a distance equal to or less than the radius of the bull's eye, of a vertical line bisecting the bull's eye, then the bull's eye display segment may be asserted to inform the shooter that the left-right control was good for the shot. Alternatively, for high-low training, if a bullet impact occurs to the left of the bull's eye but within a radius equal to or less than the bull's eye of a horizontal line bisecting the bull's eye, then the bull's eye display segment may be asserted (for example, illuminated) to inform the shooter that the high-low control was good for the shot even though the shot has not impacted the bull's eye itself. Other embodiments may utilize more sectors, for example twelve, to allow for radial reckoning, e.g., shot at the "2 o'clock" position. Any number of sectors greater than one may be utilized to indicate a general shot location to the shooter in keeping with the spirit of the invention. Any number of target sectors may be grouped together to allow for multiple bottom sectors and multiple top sectors to act in conjunction respectively for high-low practice. In this manner the controller can flash all of the bottom display segments if the shot is low or all of the top display segments if the shot is high, i.e., above the bull's eye, for example. This type of practice may be utilized for improving one's "hold", e.g., vertical control, to ensure that the shots are at the correct height on the target. Left-right practice may be utilized to improve one's horizontal control and trigger control for example. When a shooter misses the bull's eye and strikes one of the target sectors, the controller may activate one or more display segments that are near the target sector that was struck. If the shooter strikes the bull's eye, the controller may activate another light in response that displays light in the center of the target for example. Other modes or games such as timed mode may be implemented by asserting the display segments in order clockwise for example around the apparatus to indicate the amount of time left for the shot to be counted as part of the scoring for the game. For example, if the shot occurs within the time period, then the shot counts and if the shot occurs after the time period, then it counts as a miss. The time period is configurable so that each display segment is asserted for T/N where T is the time period and N is the number of display segments surrounding the target sectors.

In one or more embodiments of the invention, the controller illuminates lights to prompt the shooter to participate in one of the interactive modes or games. For example, the controller may activate lights sequentially to prompt the shooter to shoot in response to the activated lights, or select the desired mode or game. For example, embodiments of the invention that have timed-out as not having been shot at for a configurable period, may prompt the user with series of lights that indicate the specific game code to be played. If the shooter shoots a shot on target during this prompt, then that game begins. At the end of the game, the target presents the results of the game to the shooter by illuminating the lights. Embodiments of the invention may utilize any number of targets illuminated for example in a sequence to implement interactive games.

In one or more embodiments of the invention, the controller illuminates a varying number of lights associated with each target sector depending upon the distance of the point of impact from the bull's eye. For example, if a shooter strikes the uppermost target sector and misses the bull's eye by a short distance, the controller illuminates one light near the uppermost sector in response. If the shooter misses the bull's eye by a somewhat greater distance, the controller illuminates two lights near the uppermost sector in response, and so forth. Thus, a target apparatus can display a high level of gradations by employing a larger number of lights for each target sector. Alternatively, when a bullet strikes the target sector closer to the bull's eye, the higher number of lights may be shown.

In one or more embodiments of the invention, the controller may blink the lights at a frequency that reflects the distance from the point of impact to the bull's eye. For example, a bullet that strikes near the bull's eye may cause the controller blink a light at a high repetition rate, while a bullet that missed the bull's eye at a greater distance may cause the controller to blink at a slower repetition rate. Alternatively, when a bullet strikes a target sector closer to the bull's eye, the lower repetition rate may be employed.

In one or more embodiments of the invention, the controller may change the color of the light to reflect the distance of the shot to the bull's eye. For example, a first colored light may be utilized to display a close miss with respect to the bull's eye, e.g., green, while another color may be utilized to indicate a shot further from the bull's eye, e.g., red. Any other method of on-target displaying visual indication of the angular and quantitative distance of a shot from the bull's eye is in keeping with the spirit of the invention. Other embodiments of the invention may utilize analog circuitry instead of a digital controller. These embodiments may be utilized to lower costs for example in high production applications of non-networked embodiments. Various embodiments may provide for two or more training modes or games that may be selected to help a shooter improve accuracy. Any durable target apparatus or method of use that visually indicates shot impact by illuminating display segments on-target and within the field of view of the shooter when aiming at the target is in keeping with the spirit of the invention.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A durable target apparatus and method of on-target visual display will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

The invention comprises a target apparatus for firearms that is durable, portable, and easy to use. Though target apparatus 100 may be permanently installed in an indoor or outdoor shooting range, it also may include carrying handle 403 to provide any easy means to transport the apparatus to outdoor locations such as for a camping trip or around a ranch. Target apparatus 100 may be powered by as little as three AAA batteries in one or more embodiments to increase its portability. Further, target apparatus 100 is preferred to be constructed from durable materials and therefore tolerant of transport and highly reusable. All these aspects of target apparatus 100 improve upon the art to provide a user-friendly firearm target for entertainment. However, multiple operating modes or "games" of various embodiments of the invention also provide a training target so that any marksman may quickly improving shot accuracy, even when using an unfamiliar weapon, with the embodiments and methods described herein or otherwise anticipated by the invention.

Figure 1:
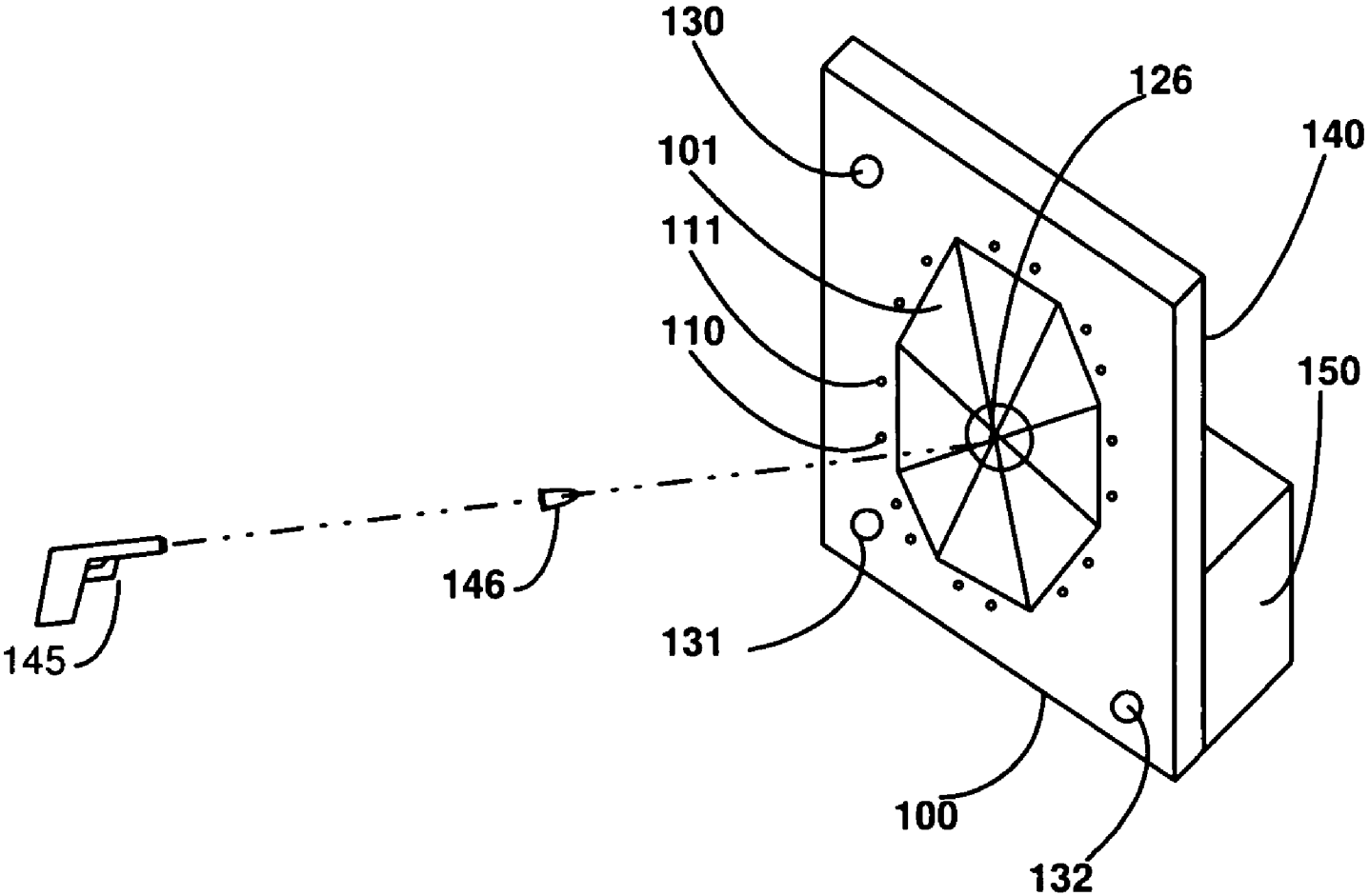
FIG. 1 depicts a firearm firing a bullet at an embodiment of the invention.

FIG. 1 depicts a gun 145 firing a projectile or bullet 146 at target apparatus 100 incorporating target sectors, for example, target sector 101 and an on-target visual display, for example, display segments 110, 111 or bull's eye display segment 126. The housing or target surface 140 and target sectors may be made from any material strong enough to absorb the energy of impact of the desired projectile type without allowing bullet 146 to penetrate target surface 140 or damage target apparatus 100, including sensors 130-132 or controller 150. Hardened implementations of target surface 140 that utilize high Brinell ratings, for example 400 or higher have high shock wave speeds and may be coupled with a dampener material, such as polyurethane, on the reverse side of surface to dampen and slow the shock wave and thus may be preferred. Any material used for target surface 140 or the target sectors that when impacted results in shockwaves faster than the iteration speed of the controller 150 through the number of sensors utilized may also employ a dampener material coupled to the non-impact side, i.e., reverse side, of target surface 140.

In one or more embodiments of the invention, quarter inch thick steel plating may be utilized to implement a durable housing configured to enable small caliber target practice. Alternatively, half inch thick steel plating may be utilized to implement a durable housing for any pistol caliber. Due to the sensitivity of the impact sensors, the thickness of the metal of target surface 140 does not have to be tuned to the desired caliber to be used with the target apparatus; hence, the thickness of target surface 140 may be chosen for cost purposes. Through use of a thick enough and/or hard enough target surface 140 and an optional dampener material mounted on the reverse side of target surface 140, any caliber weapon may be supported by a single target apparatus. Thus, the invention provides a target apparatus that does not require tuning for the caliber or energy of the bullets fired at target surface 140. In addition, the rear portion of the target does not have to be etched or grooved to isolate the sensors, as the first sensor to receive a signal is considered to be associated with the target sector impacted. Any other material or thickness may be utilized to construct the housing including aluminum or stainless steel for permanent outdoor installations, for example, to deter rusting, as long as the housing is strong enough to prevent damage from the desired bullet energy utilized during target practice.

Figure 2:
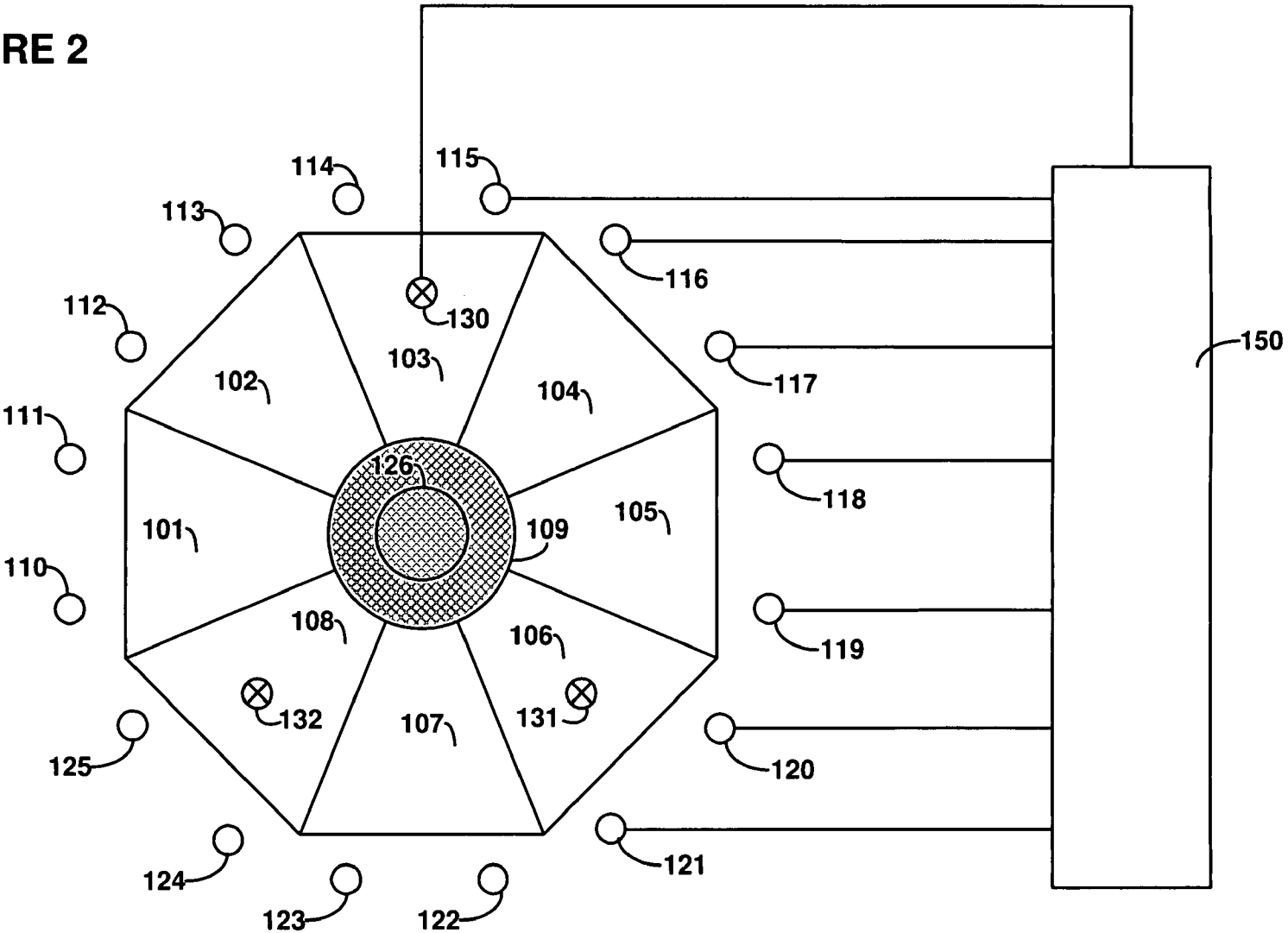
FIG. 2 illustrates additional detail of the embodiment of the invention shown in FIG. 1 and depicts the connections from the controller to the display lights and sensors.

FIG. 2 illustrates additional detail of the target apparatus 100. In one or more embodiments of the invention, target apparatus 100 includes multiple physical or virtual target sectors 101-108 that surround bull's eye target sector 109. The target sectors may be physical, for example, with embodiments that utilize sensors, e.g., impact sensors, such as piezoelectric sensors, associated with each target sector, as illustrated in FIG. 2. (While target sensors 130, 131 and 132 are illustrated as seen through the surface of target sectors 103, 106 and 108 respectively, in most embodiments it is anticipated that target sensors may be coupled to the rear side of the target surface.)

Alternatively, target sectors 101-109 may be virtual-demarcated by physical boundaries on target surface 140 with, for example, score marks, or not. When virtual target sectors are employed, target surface 140 may be smooth and/or flat, depending on the embodiment employed. Smooth or flat target surfaces may be less expensive to produce, providing a commercial advantage for such an embodiment. In the case of a smooth target with virtual sectors, target surface 140 may be constructed from a single piece of impact resistant material such as metal or bulletproof plastic.

Virtual sector embodiments work well with triangulation embodiments, as triangulation methods do not require sensors associated with each sector, so there is no operating requirement to provide physical target sectors or indicate a demarcation of target sectors for impact determination. Any triangulation method or a calculation to any reasonable accuracy level may be used to determine the impact location in such embodiments, as one skilled in the art will recognize. For example, by using the mounting positions of the sensors along with the time offsets to each sensor after the initial sensor impact detection, the triangulated position of the impact can be computed. In typical configuration of use, the shooter aims at the center of target sectors 101-109 without regards to any demarcation lines on the target. In a virtual sector embodiment, the physical sectors against which the hit will be detected may be mounted directly or indirectly on target surface 140. In one embodiment, each target sensor may be mounted via a hinge on any edge of the target sector or indirectly via a shock absorbing material such as foam and/or springs that allows each sector to receive the highest amount of impact from a shot for example.

Display segments 110-125 surround the target sectors in one or more embodiments. In one or more exemplary embodiments, as illustrated in FIG. 2, display segments 110 and 111 may be associated with target sector 101, display segments 112 and 113 may be associated with target sector 102, display segments 114 and 115 may be associated with target sector 103, display segments 116 and 117 may be associated with target sector 104, display segments 118 and 119 may be associated with target sector 105, display segments 120 and 121 may be associated with target sector 106, display segments 122 and 123 may be associated with target sector 107, display segments 124 and 125 may be associated with target sector 108, and bull's eye display segment 126 may be associated with bull's eye target sector 109. Any position, shape, grouping, or clustering of the display segments and target sectors is in keeping with the spirit of the invention so long as the display segments are utilized to show general shot placement on-target. Other embodiments utilize more or less display segments per target sector.

In one or more embodiments of the invention that employ triangulation to determine shot placement, sensors 130, 131, and 132 (typically on the rear side of target surface 140, and shown figuratively here as if seen through target sectors 103, 106 and 108 respectively) and target sectors 101-109, may be coupled in a manner to enable an acoustic or shock wave to radiate from the point of impact on target sectors 101-108 to sensors 130, 131, and 132. For example, target sectors 101-108, and bull's eye target sector 109 and sensors 130, 131, and 132 may be coupled or bonded to a common target surface 140. The bonding may be accomplished by a variety of techniques including welding, fastening, gluing, taping or using any other attachment technique. Any form of bonding or other coupling that allows an acoustic or shock wave to travel from the point of impact to the sensors 130, 131, and 132 is in keeping with the spirit of this invention. In another embodiment, target sectors 101-108, and bull's eye target sector 109 may be directly coupled with each other and to the sensors 130, 131, and 132 without use of a common target surface. Alternatively, for virtual embodiments, a single target surface 140 may be employed without use of physically distinct target sectors. As long as the target surface and/or target sectors are constructed from material that is strong enough to receive energy levels of the desired projectile, target apparatus 100 will remain undamaged after each shot impact.

In one or more embodiments of the invention, for example non-triangulation embodiments, target sectors may be associated with or coupled directly or indirectly to associated sensors. These embodiments may, for example, employ any type of impact sensor. One type of impact sensor that may be utilized includes a ball bearing backed by a spring that makes contact with two leads when the associated sector is directed rearward. Alternatively, a piezoelectric sensor may be utilized that produces a voltage when impacted for example. For example, as long as the particular impact sensor is capable of asserting an associated display segment for a configurable amount of time or sending a signal to controller 150, it may be utilized. In one or more embodiments of the invention, the target sectors coupled with the sensors may be in the form of pixels. In one or more embodiments of the invention, the target sectors and sensors employ touch screen technologies such as, but not limited to, resistive touch screens, surface acoustic wave touch screens, capacitive touch screens, infrared touch screens, infrared touch screens, strain gauge touch screens, optical imaging touch screens, dispersive signal technology touch screen, acoustic pulse recognition touch screens, frustrated total internal reflection touch screen, and diffused laser imaging touch screens. With touch screen technology based sensors, any protective covering may be utilized to protect the underlying sensors and display segments. For example, bulletproof material may be utilized to cover the sensor or display segment so long as the shot may still be detected on impact at target apparatus 100.

Regardless of the embodiment utilized, the target sectors may additionally have concentric circles, oval shaped patterns, or any other type of demarcation associated with them. In these embodiments, the number of display segments asserted (after the initial assertion indicating the sector of the hit, for example) may indicate the quantitative distance from the bull's eye. For example, with each target sector in the triangulation embodiments a distance from the center is calculated which may be translated into a "ring", i.e., a score that indicates how close to the bull's eye the shot has hit. For a bull's eye, the score is traditionally a "10." For a shot slightly away from the bull's eye, a "9" is traditionally awarded. A shot near the outer edge of the target sectors would traditionally be awarded a "7." In the triangulation embodiments, the distances that are further away from the bull's eye continue from "6" down to "0", for example. Other target shapes besides rings may be utilized in embodiments of the invention such as oval shapes or any other geometric shape, for example. For non-triangulation embodiments, with associated multiple sensors per target sector, the relative distance between the bull's eye and outer edge of the target can be calculated by the relative force of impact divided between the innermost and outermost sensor, for example, or by observing the time delay of the shockwave from the impact at the innermost and outmost sensors associated with a target sector, for example.

In one or more embodiments of the invention, sensors 130, 131, and 132 are coupled to controller 150. Display segments 110-125 and bull's eye display segment 126 are also coupled to controller 150. In operation of one or more embodiments of the invention, a shooter fires firearm 145 to cause projectile 146 to strike target apparatus 100. If the shot is not accurately delivered by the shooter, i.e., does not impact bull's eye target sector 109, then projectile 146 may hit target sector 101, for example, as the result of trigger "jerk." As projectile 146 strikes target sector 101, the projectile applies a stress to the surface of target sector 101, which in turn locally deforms target sector 101 and creates an acoustic or "shock" wave. The shock or acoustic wave radiates outward from the point of impact through target sector 101 and through target surface 140. Sensors 130, 131, and 132 continuously monitor the deformation of target surface 140. When the leading edge of the acoustic wave radiates to sensors 130, 131, and 132, sensors 130, 131, and 132 generate electric signals in response to the sounds at the point of impact or localized deformation of target surface 140. These signals are then transmitted to controller 150. In one or more embodiments of the invention, sensors 130-132 may be implemented as impact sensors or microphones. In other embodiments, impact sensors may be directly coupled to each sector and the bull's eye, for example.

In triangulation embodiments, controller 150 may determine the relative time difference among the electric signals received from sensors 130-132 and convert the relative time differences to the relative distance differences based on the speed of the acoustic wave in the medium of target surface 140. Using any known triangulation algorithm, controller 150 may calculate the position of the impact on target surface 140. Controller 150 may also determine if the bull's eye has been hit, or which target sector has been struck, by calculating the polar coordinate angle and distance of the point of impact from the center of bull's eye 126 as the center of the polar coordinate system. The polar coordinate distance determines the distance of the point of impact to the center of the bull's eye and if within the perimeter of the bull's eye, the shot registers as a hit on the bull's eye. If the shot distance is further than the radius of the bull's eye away from the center, then the shot may be associated with the particular sector residing at the calculated angle.

For non-triangulation embodiments, controller 150 may determine which sensor has been asserted and illuminate the corresponding display segment. For example, as target sector 104 receives an impact from projectile 146, one or more of display segments 116 and/or 117 may be illuminated for a time. The time for illuminating target sector 104, for example, may be programmed into controller 150 in the form of computer coded instructions, for example, as one skilled in the art will appreciate. In analog non-triangulation embodiments, controller 150 may be replaced by individual circuits that assert associated display segments with, for example, time periods set by desired potentiometer or resistance capacitive combinations, for example, as one skilled in the art will appreciate. By iterating through the sensors associated with each target sector in rapid fashion, the first sensor to register an impact may be considered to be associated with the target sector of impact. The corresponding display segment may then be illuminated for example. The shock wave may be slowed by coupling or spraying a dampener material to the reverse side of target surface 140 such as polyurethane, for example. A one-quarter inch thick layer of dampener material, or any other thickness that slows the impact's shockwave to be slow enough so that controller 150 may iteratively query enough sensors to determine which sensor was asserted first, may be preferred. Any type or thickness of dampener that allows an approximate impact location on target surface 140 to be determined by whatever means or method described herein or known in the art is in keeping with the spirit of the invention.

Digital embodiments, for example, may employ a central processor with computer readable memory as controller 150. The processor may be programmed with computer readable instructions to assert the appropriate display segments associated with the target sector that has been struck. When target sector 101 is struck, for example, controller 150 may assert display segments 110 and/or 111. For example, if the distance from the center of the bull's eye is below a predetermined first threshold, both display segment 110 and display segment 111 may be illuminated. If the distance is above the first pre-determined threshold but below a second pre-determined threshold, only display segment 110 is illuminated. If the distance is above the second pre-determined level, then only display segment 111 is illuminated. Display segment 110 and/or display segment 111 are illuminated for a preset time, and then are de-energized in anticipation of the next shot. Any other method of displaying visual indication of the angular and quantitative distance of a shot from the bull's eye is in keeping with the spirit of the invention. For example, a single display segment associated with each sector may also be used, or differing colors for multiple display segments associated with a sector may be asserted based on the distance away from the bull's eye that the shot struck.

In the event that projectile 146 strikes bull's eye target sector 109, and controller 150 determines that the distance of the point of impact from the center of the bull's eye is at or below a predetermined bull's eye threshold, bull's eye display segment 126 may be asserted. Bull's eye display segment 126 may be located anywhere within the shooter's field of view, including directly in the center of the target or, for example, flashing any combination or all display segments 110-125 for example. In embodiments that implement bull's eye target sector 109 as an opening in the target, bull's eye display segment 126 may be located in the center of the target. For embodiments that utilize a single target surface, e.g., a triangulation embodiment, or an embodiment that utilizes for example a circular sector for bull's eye target sector 109 instead of an opening, any combination of the outer display segments may be utilized to indicate a bullet has hit bull's eye target sector 109.

In one or more embodiments, target apparatus 100 may include target sectors 101-108 formed of any material that can absorb the kinetic energy of the desired projectile without causing damage to the target sector. For example, bulletproof material such as polycarbonate thermoplastic or metal may be used, and may be of a desired thickness based on the kinetic energy of the type of bullet that is to be used in association with target apparatus 100. Target sectors 101-108 can be arranged in the form of pie-shaped geometric sectors, concentric circles, tiled rectangular sectors, or as any other shape.

In an embodiment of the invention, the display segments 110-126 may be implemented as discrete light sources such as incandescent bulbs, light emitting diodes ("LEDs"), gas discharge lamps, high-intensity discharge lamps, and backlit Liquid Crystal Devices. In another embodiment of the invention, the display segments may also be devices that do not illuminate light but rather change the reflective, light polarization, or color properties of the display segment. In mechanical embodiments of the invention, a mechanical display segment may be utilized to extend a flag or move an object of a particular color into view to represent a hit in the associated sector, for example. Alternatively or in combination, an acoustic signal from controller 150 may be transmitted for example to indicate the sector (or bull's eye) location of the shot. In wireless embodiments of the invention, controller 150 may send a wireless signal to a receiver associated with shooter 145, for example, into an FM receiver or computing device that is capable of relaying the audio description of the shot to the shooter. For example, a message of "shot at three o'clock at the 8 ring" may be transmitted to a computing device that drives the audio into headphones/ear protectors worn by shooter 145. Display segments 110-126 may be covered by any type of bulletproof glass, for example, or may be formed from openings that are indirectly lit from the side so as not to incur damage when directly hit. Any method of protecting display segments 110-126 known in the art may be utilized in keeping with the spirit of the invention.

Any type of training mode or game may be implemented utilizing the display segments of embodiments of the invention. For example a game that includes asserting the display segments clockwise around the target sectors in one second intervals, wherein the shot must be taken by the time it takes for all display segments to assert may be implemented by inserting program code into controller 150. In addition, games may be played in dark conditions with iron sights or with red dot sights for example wherein the bull's eye is asserted in one color and wherein the shooter undertakes a shot that is displayed in a different color in the bull's eye for a hit, or wherein any combination of display segments are asserted or flashed for example for a miss or hit of the bull's eye. Games or modes may be selected over a network card, via a switch associated with the controller, such as a DIP switch or any other type of switch or method detectable by the controller as one skilled in the art will recognize.

In one or more embodiments of the invention, display segments may be placed on an outer perimeter near each of the target sectors. Any number of target sectors may be utilized. For example, two sectors may be utilized to train for left-right training, or high-low training to indicate which half of the target a shot strikes in various games, modes of operation, or methods of using the invention. These games may enable a shooter to improve vertical and horizontal control independently. For example, if a shot is high and outside bull's eye target sector 109, but within a distance equal to or less than the radius of bull's eye target sector 109 of a vertical line bisecting the bull's eye, then the bull's eye display segment may be asserted to inform shooter 145 that the left-right control was good for the shot. Alternatively, for high-low training, if a bullet impact occurs to the left of bull's eye target sector 109, but within a radius equal to or less than the bull's eye of a horizontal line bisecting the bull's eye, then the bull's eye display segment may be asserted to inform short 145 that the high-low control was good for the shot even though the shot has not impacted the bull's eye itself. In various embodiments the timing of the assertion and de-assertion of display segments are preferred to be rapid enough to support various types of firearms, as well as various types of training modes. In preferred embodiments, when a display segment is assert it is anticipated that the assertion will occur within about a second will provide sufficiently immediate feedback to the shooter to allow a shooter to improve. Embodiments with variable response times for the assertion and de-assertion of display segments are within the scope of the invention, so long as such times support shooter enjoyment and/or training using the target apparatus.

Other embodiments of the invention may use more sectors, for example twelve, to allow for radial reckoning, e.g., a hit at the "two o'clock" position. Any number of sectors greater than one may be utilized to indicate a sector shot location to the shooter in keeping with the spirit of the invention. Any number of target sectors may be grouped together to allow for multiple bottom sectors and multiple top sectors to act in conjunction respectively for high-low practice. In this manner the controller can flash all of the bottom display segments if the shot is low or all of the top display segments if the shot is high, i.e., above the bull's eye, for example. This type of practice may be utilized for improving one's "hold," e.g., vertical control, to ensure that the shots are at the correct height on the target. Left-right practice may be utilized to improve one's horizontal control and trigger control for example. When a shooter misses the bull's eye and strikes one of the target sectors, the controller activates one or more display segments that are near the target sector that was struck. If the shooter strikes the bull's eye, the controller activates another light in response that displays light in the center of the target for example.

In one or more embodiments of the invention, display segments may be placed on an outer perimeter near each of the target sectors. Any number of target sectors may be utilized. For example, two sectors may be utilized to train for left-right training, or high-low training to indicate which half of the target a shot strikes. This enables a shooter to improve vertical and horizontal control independently for example. For example, if a shot is high and outside bull's eye target sector 109, but within a distance equal to or less than the radius of bull's eye target sector 109 of a vertical line bisecting the bull's eye, then the bull's eye display segment may be asserted to inform shooter 145 that the left-right control was good for the shot. Alternatively, for high-low training, if a bullet impact occurs to the left of bull's eye target sector 109, but within a radius equal to or less than the bull's eye of a horizontal line bisecting the bull's eye, then the bull's eye display segment may be asserted to inform short 145 that the high-low control was good for the shot even though the shot has not impacted the bull's eye itself.

Other embodiments of the invention may use a greater number of target sectors, for example twelve, to allow for radial or "o'clock" reckoning, e.g., hit at the two o'clock position. It is in keeping with the spirit of the invention that any number of target sectors greater than one may be used to indicate what sector location received an impact. Any number of target sectors may also be grouped together to allow for multiple bottom sectors and multiple top sectors to act in conjunction respectively for high-low practice. In this manner, the controller may flash all of the bottom display segments if the shot is low or all of the top display segments if the shot is high, i.e., above the bull's eye, for example. This type of display enables practice to improve one's "hold," e.g., vertical control, to ensure that the shots are at the correct height on the target, without moving one's eye from the target, which is an improvement over targets of the prior art. The invention also better supports "left-right" practice that may improve one's horizontal control and trigger control, for example. When a shooter misses the bull's eye and strikes one of the target sectors, controller 150 may activate one or more display segments 110*a* that are nearest the target sector that was struck. If the shooter strikes bull's eye target sector 109, controller 150 may activate a display segment that light the center of the target, for example.

In one or more embodiments of the invention, the controller illuminates a varying number of lights associated with each target sector depending upon the distance of the point of impact from the bull's eye. For example, if a shooter strikes the uppermost target sector and misses the bull's eye by a short distance, the controller illuminates one light near the uppermost sector in response. If the shooter misses the bull's eye by a somewhat greater distance, the controller illuminates two lights near the uppermost sector in response, and so forth. Thus, a target apparatus can display a high level of gradations by employing a larger number of display segments for each target sector. Alternatively, when a bullet strikes the target sector closer to the bull's eye, the higher number of lights may be shown.

Figure 3A:
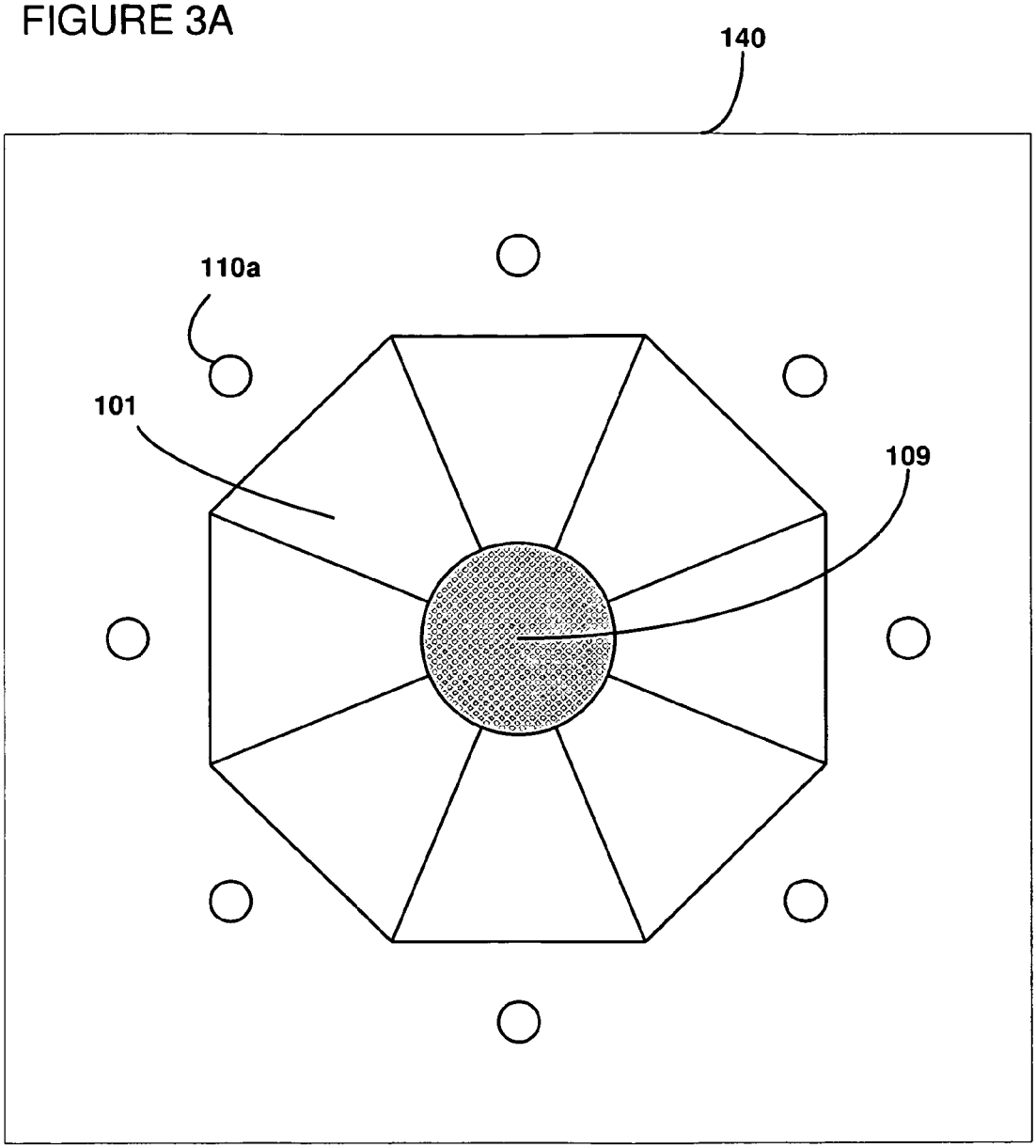
FIG. 3A illustrates a front view of an embodiment of the invention.

FIG. 3A illustrates a front view of one or more embodiments of the invention where each target sector, such as target sector 101, may be associated with a single display segment, such as display segment 110*a*. Bull's eye target sector 109 may be implement as a circular opening providing access for a bullet passing through bull's eye target sector 109 to reach sensor plate 509 (see FIG. 5) located behind bull's eye target sector 109 in one or more embodiments of the invention.

In embodiments such as that of FIG. 3A, each display segment may be located at some radial offset from and some distance beyond each target sector. In preferred embodiments, display segment 110*a* will be located on the surface of the target and within the field of view of the shooter as the shooter aims at the target. In one or more such embodiments, display segments 110*a* may be implemented as a light emitting diode (LED) or some similar display technology. Preferred embodiments may implement display segment 110*a* as a red LED.

Figure 3B:
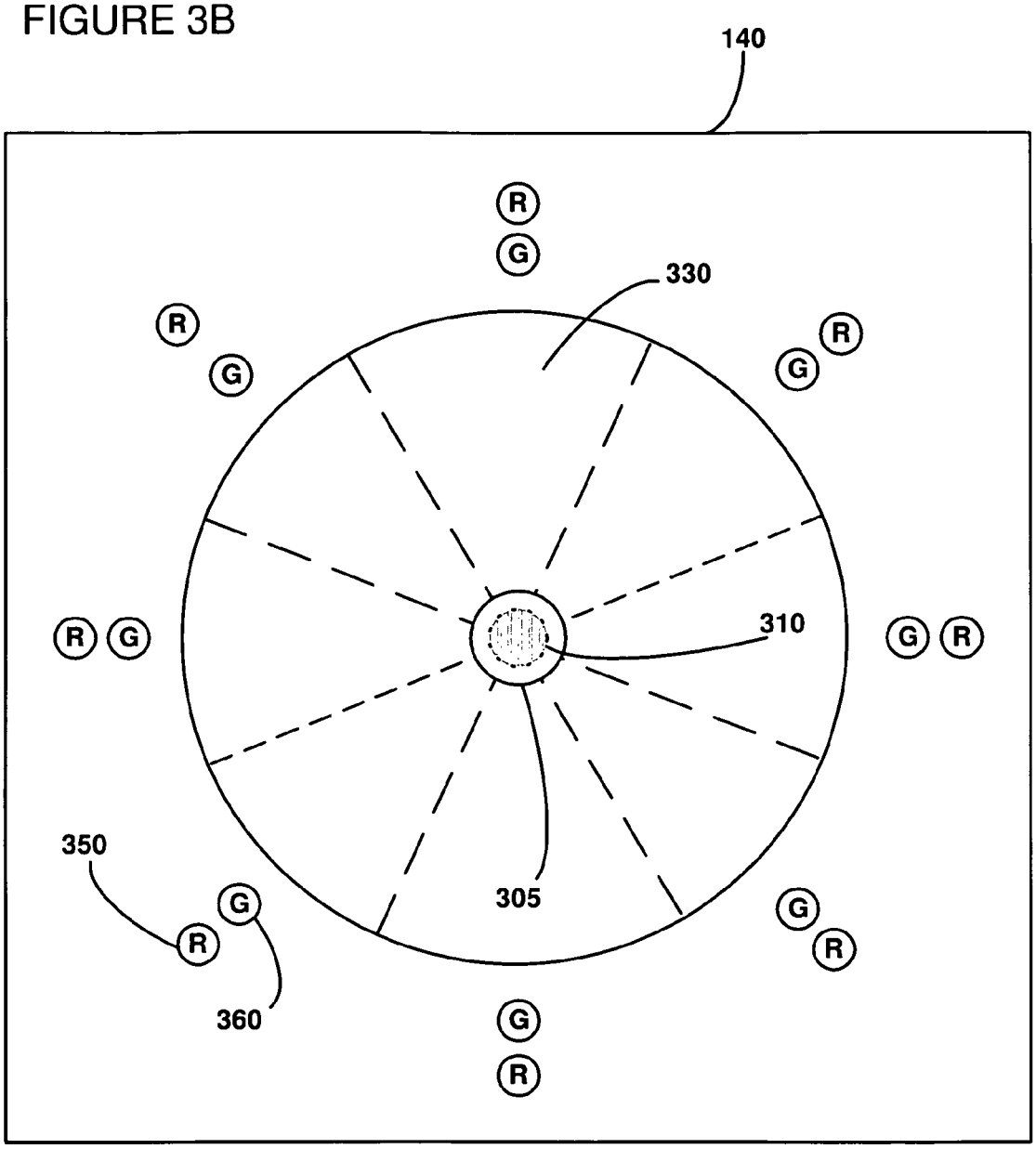
FIG. 3B illustrates a front view of one or more alternative embodiments demonstrating virtual target sectors and multiple display segments per sector and an interchangeable bull's eye target sector opening.

FIG. 3B illustrates a front view of an embodiment of the invention having virtual target sectors 330 and a detachable bull's eye target sector 305. While shown together in this exemplary embodiment, detachable bull's eye target sector 305 and the use of virtual target sectors for the remaining sectors on target surface 140 may be implemented separately in various embodiments of the invention. Bull's eye target sector 305 may be detached from the target and various sized embodiments thereof may be interchanged to provide variable difficulty level as desired. Variable size bull's eye target sector 305 may be coupled to an isolated high-speed impact sensor. In addition, by interchanging bull's eye target sector 305 in bull's eye opening 310 with various sized embodiments, detecting an impact to bull's eye sector plate 305 may be easily determined by controller 150 no matter the size of sector 305, all without the need to perform complex triangulation calculations and without requiring arbitration or timing circuitry. In this manner, the outer sectors may simply be iteratively queried to determine the closest point of impact, thereby greatly simplifying the logic required for controller 150.

FIG. 3B also illustrates an embodiment utilizing display segments of two LEDs instead of one multi-colored or single colored LED per target sector. FIG. 3B illustrates an embodiment of display segments 350 as a red LED 350 and 360 as a green LED, each per virtual target sector 330. Any number of LEDs in combination, or alternatively a single multi-colored LED, may be utilized in one or more embodiments of the invention to implement any of the display segments. FIG. 3B further illustrates a detachable bull's eye target sector 305 inserted into opening 310 in target surface 140.

It should be noted that while virtual target sectors 330 are shown as scored marks on target surface 140 in FIG. 3B, such scoring is optional. As discussed above, embodiments utilizing virtual target sectors that present a completely flat surface to the shooter are within the scope of the invention.

By mounting the embodiment shown in FIG. 3B on a rail and moving the device, for example left and right, a moving target game may be played. Likewise, multiple targets of the invention may be networked together and coupled to a computer, for example, to control asserting various display segments (for example around the sides of the target) to alert a shooter which particular target to shoot. These types of games allow a shooter to rapidly improve in real-world situations with movement and shot selection that may also be timed. For example, by configuring a computer to indicate various targets in random order and programming controller 150 with given time in which to assert its display segments, a game may be constructed where a shooter is given that amount of time to execute a shot at a particular target. In such a game, the target may be programmed to flash all display segments a single color, red for example, to indicate that the shot was too late.

Figure 3C:
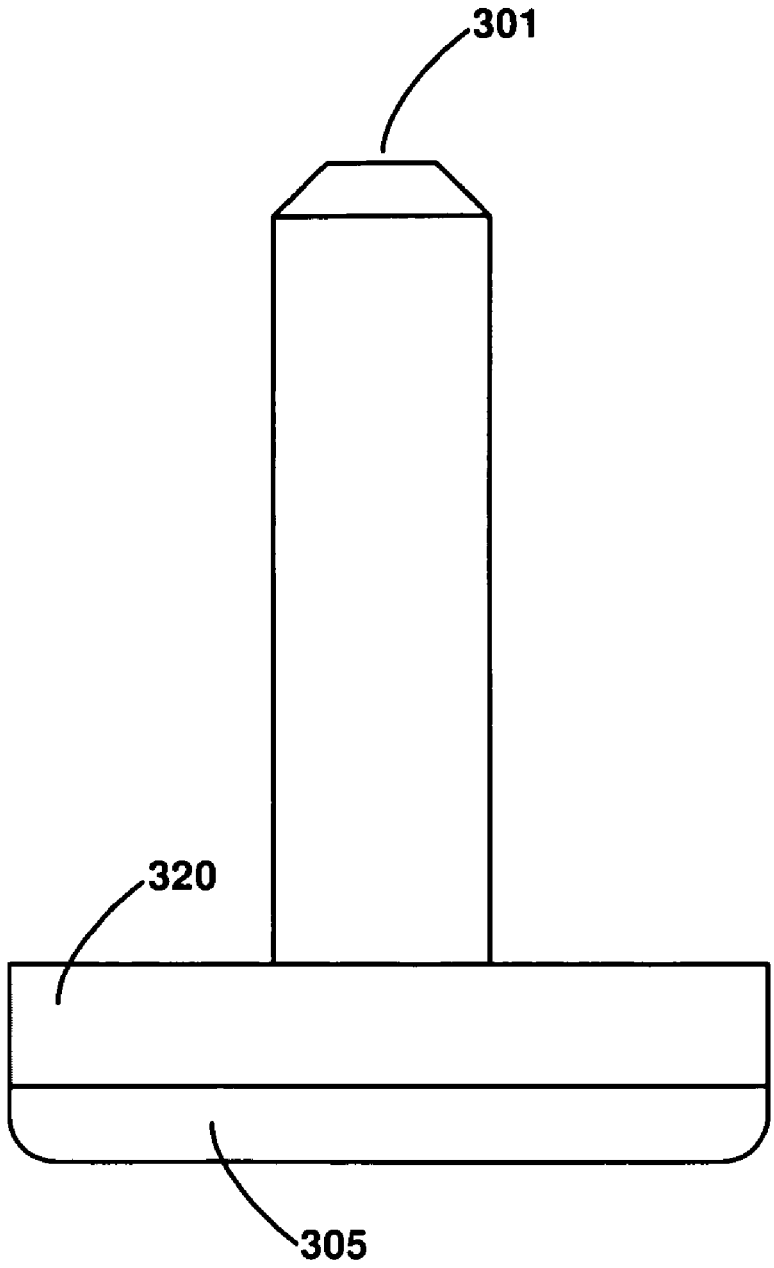
FIG. 3C illustrates a side view of an interchangeable bull's eye target sector.

FIG. 3C illustrates a side view of the interchangeable bull's eye target sector 305 having a shock-absorbing element 320 and plunger 301 that couples bull's eye target sector 305 to an impact sensor at the rear side of the target surface. Quick-recovery polyurethane, or similar material, may be used as shock-absorbing element 320 in one or more embodiments. Shock absorbing element 320 is may also be implemented using a nut welded to the rear of bull's eye target sector 305. In one or more embodiments, shock-absorbing element 320 is optional.

Bull's eye target sector 305 may be made from a work-hardened material such as milled steel in one or more embodiments of the invention. In a preferred embodiment, bull's eye target sector 305 might be expected to withstand 10,000-20,000 rounds if made from a steel alloy with Brinell hardness of about 400 or higher. In virtual target embodiments with a bull's eye target sector that does not use circular opening 109 or bull's eye target sector 305 and opening 310, the size of the bull's eye target sector (not shown) may be computed by controller 150 as half the distance to each nearest sensor and approximately a circle with slight contracts at angles that intersect the position of a sensor.

Figure 4:
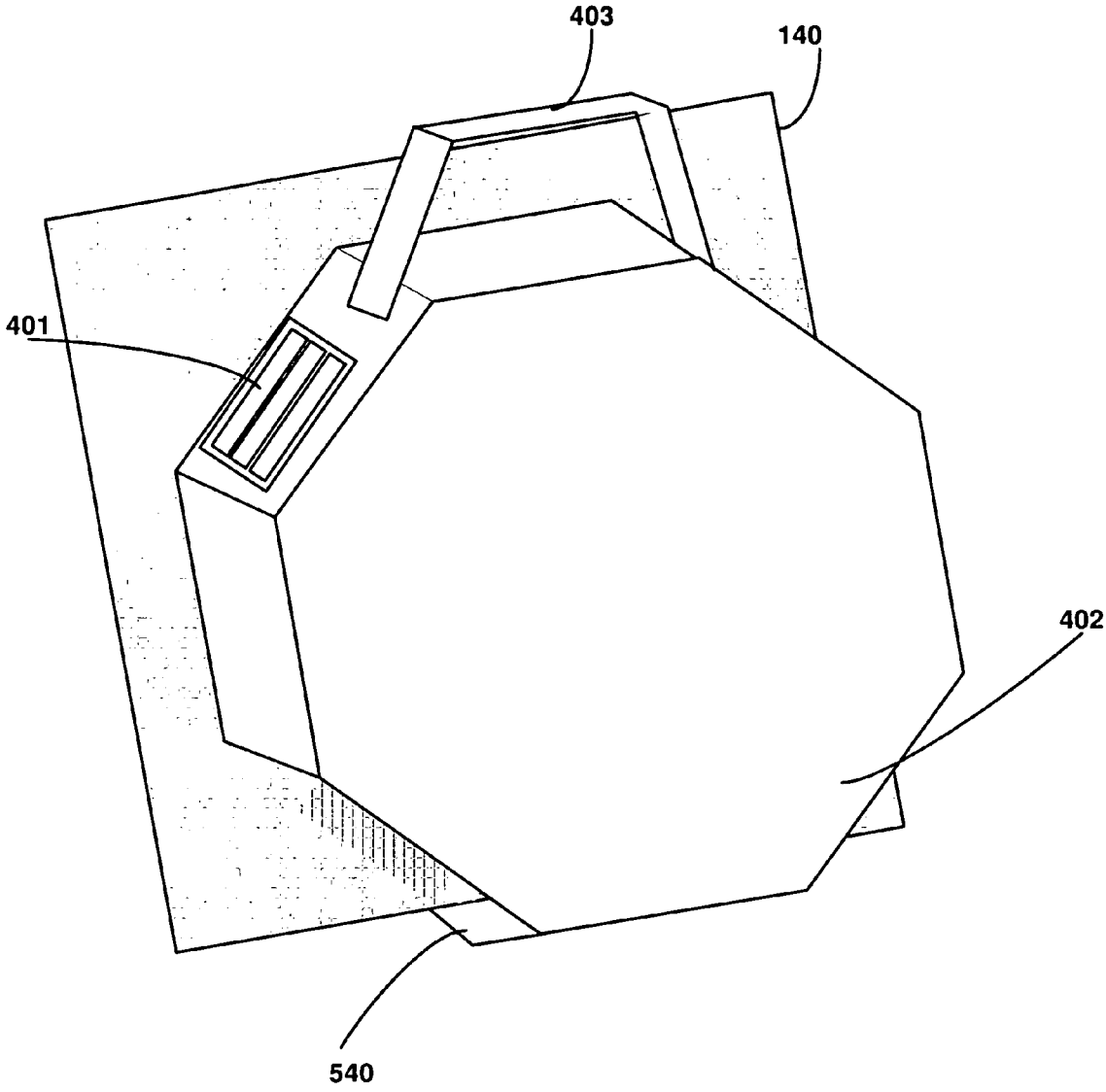
FIG. 4 illustrates a rear perspective view of an embodiment of the invention.

FIG. 4 illustrates a rear perspective view of an embodiment of the invention. Battery pack 401 may be configured to power the various display segments and controller circuitry, for example controller 150. One or more embodiments may operate on as little as about 4.5 volts, which may be provided from three AAA batteries, as illustrated in optional battery pack 401. However, any power source capable of providing enough power for the display segments and controller utilized in the particular embodiment may be utilized in place of battery pack 401 to power the invention. Embodiments intended to be permanently installed or mounted in indoor shooting ranges, for example, may utilize other power supplies well known to those of ordinary skill in the electrical arts. Case back 402 is shown latched closed in FIG. 4 to protect the internal circuitry of target apparatus 100. Handle 403 may be utilized to carry the target.

Figure 5:
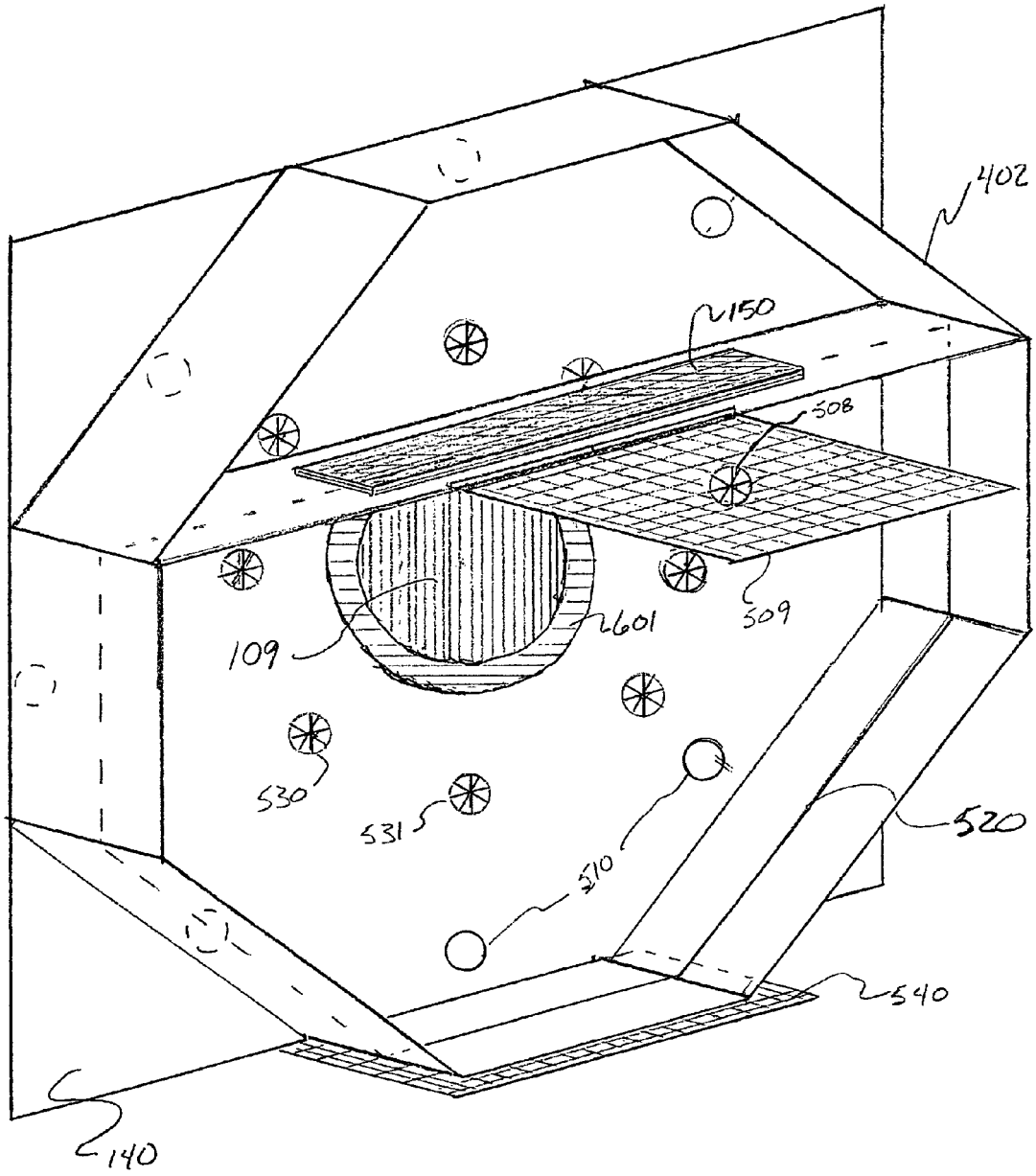
FIG. 5 illustrates rear perspective view of the interior of an exemplary non-triangulation embodiment of the invention having sensors associated with each target sector and bull's eye.

FIG. 5 illustrates an interior, rear perspective view of a non-triangulation embodiment having sensors, such as 530 and 531 shown here, associated with each target sector. Each sensor, for example impact sensor 530, shown here on the back of each associated target sector, may directly determine the shot impact location on a sector per sector basis. In this embodiment, the bull's eye sensor 508 is located on the back side of sensor plate 509, shown flipped up horizontally here to allow for a rear view of bull's eye target sector 109, shown here as a circular opening in target surface 140. When in use, this embodiment allows a projectile passing through bull's eye target sector 109 from the front of target surface 140 to strike the front of sensor plate 509 when 509 is in the vertical (operating) position. In such embodiments, one or more bull's eye display segment(s) (such as 601, ) may emit light onto the front of sensor plate 509, but preferably are sheltered from projectile impact by target surface 140. Bull's eye display segment 601 may be located on the back of target surface 140 surrounding bull's eye target sector 109 and thus may illuminate the front of sensor plate 509 when plate 509 is in its operating position. In this embodiment, the illumination of the bull's eye display segment(s) will be visible to the shooter through circular opening 109, indicating to the shooter that the projectile passed through the bull's eye.

FIG. 5 also illustrates protective sheet 520, shown as clear plastic, for example, within case 402 to protect the various components from projectiles or projectile fragments while allowing a view of the components when the device is opened. Any type of protective sheet known in the art to provide such protection may be used.

In one or more embodiments, when a projectile enters the bull's eye opening and impacts sensor plate 509, electrical wires coupling bull's eye sensor 508 on the back of sensor plate 509 transmits a signal to controller 150. Wires are also used to couple controller 150 electronically to one or more display segments 510. The wires may be used to couple controller 150 to the respective components in one or more embodiments of the invention. Any type of wire may be utilized as long as it is capable of enabling the proper amount of current flow based on the type of sensors and display segments utilized.

Flat base 540 may be used to allow for mounting the target on a track, rail or other means known in the art for a moving target embodiment or to an adjustable base for a variety of shooting height (i.e., for use by shooters in a prone, kneeling or standing positions) in one or more embodiments of the invention.

Figure 6:
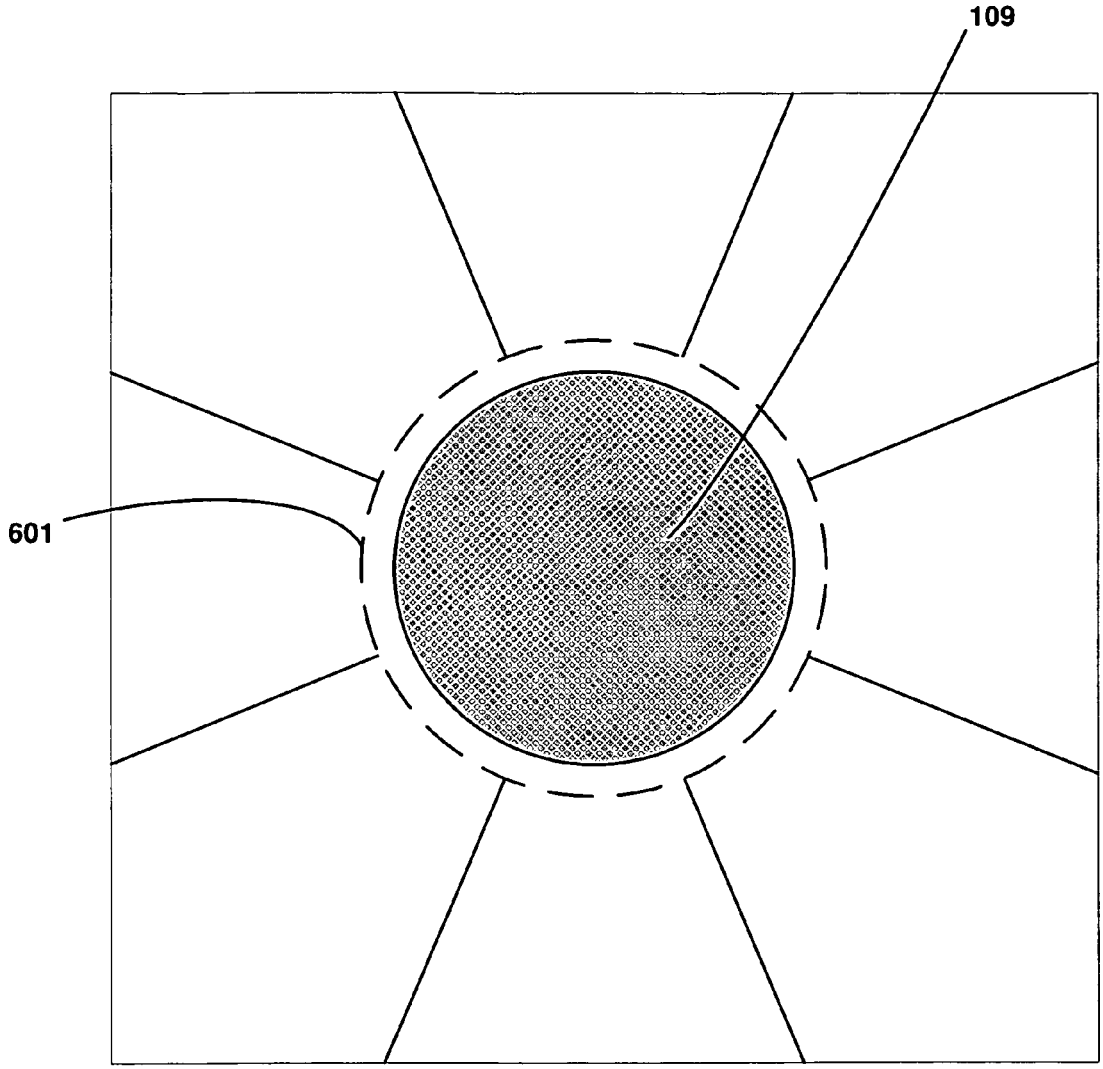
FIG. 6 illustrates a front view of an embodiment of the bull's eye display segment as asserted upon the impact of a shot that is placed in the bull's eye.

FIG. 6 illustrates a front view of bull's eye target sector 109, shown here as a circular opening in another embodiment of the invention. In such embodiments, bull's eye display segment 126 may be implemented a illustrated here as display segment 601 may emit light onto the front side of sensor plate 509 when bull's eye sensor 508, on the rear of sensor plate 509, detects an impact on the sensor plate. The illumination from display segment 601 may be visible through bull's eye target sector 109 in one or more embodiments of the invention. Display segment 601 may be implemented as a light emitting diode or other display segment type described herein, or known to one of skill in the art, in one or more embodiments of the invention. Within the scope of the invention, display segment 601 may be round, may be one or more LEDs mounted on the right, left, top and/or bottom of the back side of target surface 140, or may be implemented as any other display means and/or fixture known to those of skill in the art. In preferred embodiments, display segment 601 may be sheltered from direct impact by bullet 146 by target surface 140, and yet its display will be visible to a shooter downrange of the target apparatus through bull's eye target sector 109.

A bullet may travel through the opening of bull's eye target sector 109 in some embodiments; however, other embodiments may instead provide bull's eye target sector 305 as mounted flush or flat with the bull's eye opening 310. Bull's eye target sector 305 may be flush with the other target sectors, be raised above the surface of the target, or may be depressed below the target surface. In one or more embodiments, a bullet impacting bull's eye opening may cause the invention to illuminate all display segments in one or more modes, such as flashing or asserted all display segments at once, for example, instead of lighting light 601 as shown in FIG. 6.

Figure 7:
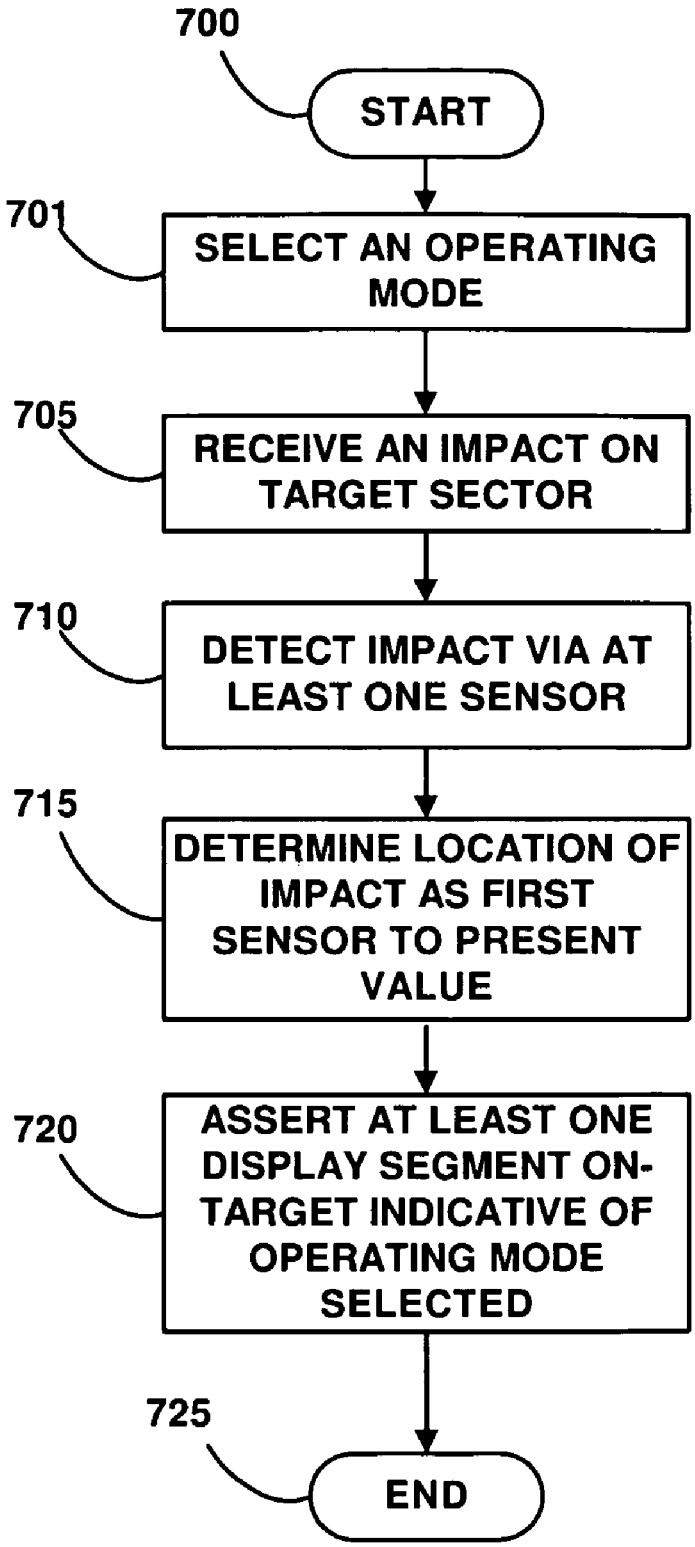
FIG. 7 illustrates a flow chart for a method of using an embodiment of the invention.

FIG. 7 illustrates an exemplary method of using an embodiment of the invention. The method starts at step 700. At step 701 an operating mode or "game" is selected. The operating mode may determine if a display segment is asserted following an impact. Where a display segment is a multicolor LED, for example, in a given operating mode impacting the "wrong" sector may cause the associated display segment to light "red." In an alternative "game," detecting an impact on any sector may cause its associated display segment to illuminate "green." As a default operating mode, for example, a display segment may light green when its associated target sector is impacted. At step 705, the target received an impact on a target sector, or on the target surface in the case of virtual target sectors. The impact is detected by at least one sensor at 710. In one or more embodiments, the sensors output a value that indicates an impact has been detected, for example a voltage of a particular level. At step 715, the location of the impact is determined as associated with the first sensor to have a value read, e.g., by iterating through all sensors, wherein the value indicates an impact has been detected. At step 720, at least one display segment is asserted depending on the current mode or game selected, i.e., general sector location, high-low practice, left-right practice or timed practice. As previously discussed, the display segment(s) may be asserted depending on the target sector detecting the impact, or alternatively the side of the target surface where the impact has occurred, for example in a high/low or left/right mode, or in an alternative game, if the impact is detected within a particular distance (diameter) from bull's eye target sector 109. In still other operating modes, various embodiments of the invention may provide a "clocked" game, where display segments may be asserted sequentially to indicate how much time has expired (and how much time remains) top complete the next shot. In such embodiments, the impact may show as a colored segment or bull's eye display segment may be asserted. Any variation on the number of display segments, colors or time duration of asserting display segment(s) is in keeping with the spirit of the invention for these or any other games that may be implemented with various embodiments of the invention. The method ends at step 725. In preferred embodiments the apparatus is pre-programmed to resets itself in a time sufficient for the current operating mode or game.

The following table provides pseudocode understood by those in those of ordinary skill in the programming arts that represent a possible computer program to implement some of the games that may be played with embodiments of the invention. This pseudocode is only an example; any method of programming the games described herein is contemplated by various embodiments of the invention.

```
num_shots_remaining = NUM_SHOTS;   // e.g., 10 shots per game
while (num_shots_remaining) {
  if (game_selection == NEAREST_SECTOR_GAME) {
      while (num_shots_remaining)
        for (i=0; i<NUM_SENSORS; i++)
          if (sensor[i]) {      // poll sensors sequentially to find first one
            assert (display_segment[i], TRUE); // turn it on
            delay(TIME_DELAY);       // for a configurable time, show LED near hit
            assert(display_segment[i], FALSE); // turn it off
            num_shots_remaining -= 1;
          }
  } else if (game_selection == TIMED_GAME) {
    while (num_shots_remaining)
        for (i=0; i<NUM_DISPLAY_SEGMENTS; i++)
          assert(display_segment[i]);
```

-continued

```
            if (hit_sector = poll_sensors(TIME_PER_DISPLAY_SEGMENT)) {
              assert_all(FALSE); // turn off all LEDs
              assert(hit_sector, TRUE);
            }
  } else if (game_selection == LEFT_RIGHT_GAME) {
      while (num_shots_remaining)
        for (i=0; i<NUM_SENSORS; i++)
          if (hit_sector = sensor[i]) {    // first one to hit is the hit sector
            if (hit_sector == TWELVE_OCLOCK ||
              hit_sector == SIX_OCLOCK ||
                hit_sector== BULLS_EYE) {
                  assert (TWELVE_OCLOCK, TRUE); // turn it on
                  assert (SIX_OCLOCK, TRUE); // turn it on
                  assert (BULLS_EYE, TRUE); // turn it on
                  delay(TIME_DELAY);        // for a configurable time, show LED near hit
                  assert (TWELVE_OCLOCK, FALSE); // turn it off
                  assert (SIX_OCLOCK, FALSE); // turn it off
                  assert (BULLS_EYE, FALSE); // turn it off
            } else if (hit_sector > SIX_OCLOCK and hit_sector < TWELVE_OCLOCK)
                  for (i=(SIX_OCLOCK+1); i<TWELVE_OCLOCK; i++)
                    assert(i, TRUE); // turn on all LEFT side LEDs if shot to the left of the bull's eye
                  delay(TIME_DELAY);
                  for (i=(SIX_OCLOCK+1); i<TWELVE_OCLOCK; i++)
                    assert(i, FALSE); // turn off all LEFT side LEDs
            } else if (hit_sector > 0 and hit_sector < SIX_OCLOCK)
                  for (i=0; i<SIX_OCLOCK; i++)
                    assert(i, TRUE); // turn on all RIGHT side LEDs if shot to the left of the bull's
eye
                  delay(TIME_DELAY);
                  for (i=0; i<SIX_OCLOCK; i++)
                    assert(i, FALSE); // turn off all RIGHT side LEDs
            }
            num_shots_remaining -= 1;
          }
  } else if (game_selection == HIGH_LOW_GAME) {
      while (num_shots_remaining)
        for (i=0; i<NUM_SENSORS; i++)
          if (hit_sector = sensor[i]) {    // first one to hit is the hit sector
            if (hit_sector == THREE_OCLOCK ||
              hit_sector == NINE_OCLOCK ||
                hit_sector== BULLS_EYE) {
                  assert (THREE_OCLOCK, TRUE); // turn it on
                  assert (NINE_OCLOCK, TRUE); // turn it on
                  assert (BULLS_EYE, TRUE); // turn it on
                  delay(TIME_DELAY);        // for a configurable time, show LED near hit
                  assert (THREE_OCLOCK, FALSE); // turn it off
                  assert (NINE_OCLOCK, FALSE); // turn it off
                  assert (BULLS_EYE, FALSE); // turn it off
            } else if ((hit_sector >= 0 and hit_sector < THREE_OCLOCK) ||
                    (hit_sector > NINE_OCLOCK and hit_sector < TWELVE_OCLOCK)) {
                  for (i=0; i<THREE_OCLOCK; i++) {
                    assert(i, TRUE);
                    assert(i+NINE_OCLOCK, TRUE); // turn on all UPPER LEDs if shot is above
the bull's eye
                  }
                  delay(TIME_DELAY);
                  for (i=0; i<THREE_OCLOCK; i++) {
                    assert(i, FALSE);
                    assert(i+NINE_OCLOCK, FALSE); // turn off all UPPER LEDs if shot is above
the bull's eye
                  }
            } else if ((hit_sector > THREE_OCLOCK and hit_sector < NINE_OCLOCK) {
                  for (i=THREE_OCLOCK+1; i<NINE_OCLOCK; i++)
                    assert(i, TRUE);
                  delay(TIME_DELAY);
                  for (i=THREE_OCLOCK+1; i<NINE_OCLOCK; i++)
                    assert(i, FALSE);
            num_shots_remaining -= 1;
          }
}
```

Figure 8:
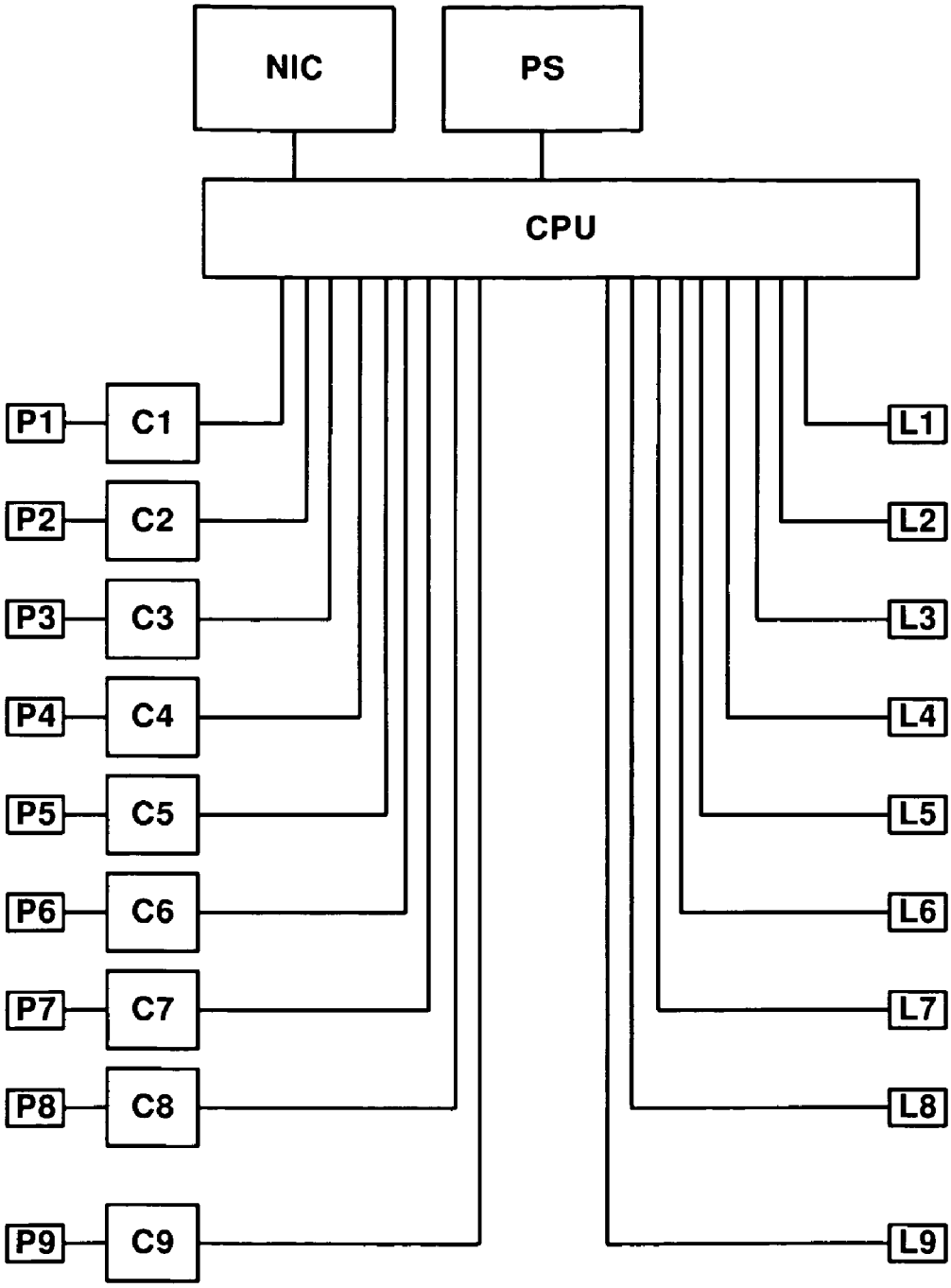
FIG. 8 illustrates a hardware diagram for an embodiment of the invention.

FIG. 8 illustrates a hardware diagram for an embodiment of the invention. FIG. 8 is exemplary as one skilled in the art will recognize in that the various components listed herein may be substituted for other components or technologies that provide equivalent functionality and are not intended in a limiting fashion in any manner. As shown, one or more embodiments may include a central processing unit "CPU". An example central processing unit that may be utilized in one or more embodiments of the invention includes the AMTEL® ATMEGA8535. This CPU includes 32 I/O ports that are coupled with comparators C1-C9, for example LM393 comparators from NATIONAL SEMICONDUCTOR®. The comparators convert a threshold level voltage from sensors P1-P9, for example piezoelectric sensors model number 3022-002 from MEASUREMENT SPECIALTIES® into a logical TRUE or FALSE for input to the CPU. Upon detection of a logical TRUE from one of the comparators, or alternately from the first comparator when multiple comparators send a logical TRUE (in case of high impact energy of the bullet), a corresponding display segment L1-L9 may be asserted. L1-L9 may be implemented in one or more embodiments of the invention with any 5 mm Red/Green LED for example. Power source "PS" may be any power source capable of supporting the CPU and the various components shown on FIG. 8, for example battery pack 401 that includes off the shelf batteries, alternatively the power source may be implemented with a transformer and diodes to allow for connection to a standard 120 V power outlet. Network interface component "NIC" may be utilized for coupling the CPU to any other computing element using any network protocol, for example, TCP/IP. The NIC enables multiple target apparatus to form a game, e.g., a sequence of targets that flash in order that shooter 145 is prompted to shoot at. One embodiment of NIC that may be utilized may include any 802.11b wireless local area network chip for example, for example the SA2400 from PHILIPS®, to provide for target apparatus communication without the need for network cables. Alternatively, any wire based NIC may be utilized for permanent installations for example.

Various embodiments of the invention may use a non-triangulation approach to detecting the impact of a bullet on the target. Such embodiments may have sensors, such as sensor 530, coupled with the reverse side of the target surface. In such embodiments, the first sensor to receive a signal may be used to decide the approximate location of an impact. Detection of impact may be with software scanning of strike sensors and/or hardware circuitry latching any and all strikes for processor to read via software. By iterating through all I/O ports (preferably at approximately 400,000 per second), no complex arbitration circuitry will be required. The first sensor activated may be used to declare which sector received the impact. For high-low practice, if that sensor happens to be at nine o'clock or at three o'clock, or the impact is sensed first by bull's eye target sector 109's sensor, then both outer display segments (at nine and three o'clock) for example may be asserted green. This may indicates that the shot was placed at the correct vertical offset on the target. If any of the other sensors is the first to register the shot impact, then all of the upper or lower sensors may be asserted red to indicate a shot impact that was hi or low respectively. For left-right practice, if the first sensor to register an impact is at twelve o'clock or six o'clock, or is sensed by the bull's eye sensor first, then both upper and lower display segments (at twelve and six o'clock) for example may be asserted green. If any of the other sensors is the first to register the shot impact, then all of the left or right may be asserted red to indicate a shot impact that was left or right respectively. Alternatively, controller 150 may be commanded remotely, for example, to switch to standard sector based practice where the first sensor to register a shot impact is sensed by controller 150 as it iterates through the I/O ports and the corresponding sector display segment may be asserted for a configurable amount of time. In one or more embodiments of the invention, a DIP switch may be utilized by controller 150 to sense a desired time value that the display segments are to be asserted after a shot impact, in other embodiments of the invention, the time to assert a display segment may be stored in memory in controller 150 or coupled with controller 150.

While the invention herein disclosed has been described by means of specific embodiments and applications thereof, numerous modifications and variations could be made thereto by those skilled in the art without departing from the scope of the invention set forth in the claims.

What is claimed is:

1. A target apparatus comprising:

a target comprising at least one target sector comprised of a steel plate that is impenetrable to bullets and coupled to said target and configured to withstand an impact from a bullet, wherein the target apparatus remains undamaged after each shot impact;

a plurality of display segments located on said target and within a field of view of a shooter viewing said target and configured so as not to incur damage when directly hit, wherein each target sector is associated with one or more display segments that enable a shooter to determine the target sector hit by the bullet, and wherein the target provides immediate feedback to allow the shooter to improve, at least one sensor coupled to said at least one target sector and configured to detect said impact of said bullet; and wherein the impact of the bullet on the target creates an impact shock wave with a speed, wherein the target has a non-impact side, further comprising a dampening material coupled to the non-impact side of the target surface to slow down the impact shock wave and allow iterative scanning by sensors configured to locate the impact of the bullet on the target; and a controller electronically coupled to said at least one sensor and configured to determined an impacted target sector associated with said impact from said bullet on said at least one target sector using a first sensor selected from said at least one sensor, wherein the controller has an iteration speed, and wherein the speed of the impact shock wave is greater than the iteration speed of the controller; and wherein said controller is further coupled to said plurality of display segments and further configured to assert at least one display segment selected from said plurality of display segments as determined by said determined impacted target sector and a current operating mode of said target selected from a plurality of operating modes.

2. The target apparatus of claim 1 wherein said controller comprises a central processing unit having computer readable program memory and further comprising computer readable program instructions, said computer readable program instructions configured to assert at least one display segment selected front said plurality of display segments.

3. The target apparatus of claim 2 wherein controller comprises electronic circuitry configured to assert said display segment for a configurable period following said impact.

4. The target apparatus of claim 1 further comprising:

wherein said at least one target sector further comprises at least a first target sector and a second target sector, and wherein said first target sector comprises a bull's eye sector centrally located on said target, wherein the target has a surface, and wherein the bull's eye sector is raised above the surface of the target.

5. The target apparatus of claim 4 wherein said controller comprises a central processing unit having computer readable program memory and further comprising computer readable program instructions, said computer readable program instructions further configured to assert said at least one display segment corresponding to said impact of said bullet on said bull's eye target sector.

6. The target apparatus of claim 1 further comprising:

wherein said plurality of display segments comprises at least a bull's eye display segment and at least one additional display segment.

7. The target apparatus of claim 1 wherein said at least one target sector further comprises at least one virtual target sector as computed by said controller using said at least one sensor.

8. The target apparatus of claim 1 wherein said at least one target sector further comprises at least one physical target sector mechanically coupled to said target.

9. The target apparatus of claim 1 wherein said target further comprises a flat target surface.

10. The target apparatus of claim 1 wherein said at least one sector is coupled to at least three impact sensors.

11. The target apparatus of claim 1 further comprising:

wherein said at least one target sector further comprises a detachable, plug-shaped, circular bull's eye target sector.

12. The target apparatus of claim 1 wherein said controller comprises a central processing unit having computer readable program memory and further comprising computer readable program instructions, said computer readable program instructions further configured to assert said at least one display segment to indicate an amount of time remaining for said impact to count in said current game.

13. The target apparatus of claim 1 wherein said controller comprises a central processing unit having computer readable program memory and further comprising computer readable program instructions, said computer readable program instructions further configured to assert said at last one display segment that corresponds to high/low status of said impact of said bullet on said target with respect to a bull's eye diameter.

14. The target apparatus of claim 1 wherein said controller comprises a central processing unit having computer readable program memory and further comprising computer readable program instructions, said computer readable program instructions further configured to assert said at least one display segment that corresponds to left/right status of said impact of said bullet on said target sector with respect to a bull's eye diameter.

15. The target apparatus of claim 1 wherein said controller comprises a central processing unit having computer readable program memory and further comprising computer readable program instructions, said computer readable program instructions further configured to assert said at least one display segment for a configurable time period following said impact.

16. The target apparatus of claim 1, wherein the at least one sensor is a piezoelectric sensor.

17. The target apparatus of claim 1. wherein the at least one sensor comprises a ball bearing backed by a spring that makes contact with two leads when the impacted sector is directed rearward.

18. A firearm target system comprising:

a durable firearm target comprising at least one target sector comprised of a steel plate that is impenetrable to projectiles and coupled to said target and configured to withstand an impact from a projectile, wherein the target system remains undamaged after each shot impact;

a plurality of display segments located on said target and within sight of a shooter when said shooter aims a firearm at said target and configured so as not to incur damage when directly hit, wherein each target sector is associated with one or more display segments that enable a shooter to determine the target sector hit by the projectile, and wherein the target provides immediate feedback to allow the shooter to improve;

at least one sensor coupled to said at least one target sector, said at least one sensor configured to detect said impact of said projectile on said at least one target sector;

wherein the impact of the projectile on the target creates an impact shock wave with a speed, wherein the target has a non-impact side, further comprising a dampening material coupled to the non-impact side of the target surface to slow down the impact shock wave and allow iterative scanning by sensors configured to locate the impact of the projectile on the target; and a controller comprising a central processing unit, a computer readable program memory and computer readable program instructions, said computer readable program instructions configured to determine an impact on said at least one target sector and further configured to then assert at least one of said plurality of display segments such that said asserted at least one display segment provides a visible indication to said shooter of said impact on said at least one target sector, wherein the controller has an iteration speed, and wherein the speed of the impact shock wave is greater than the iteration speed of the controller.

19. A method of utilizing a target apparatus comprising:

selecting an operating mode for a target from at least two available operating modes, said target comprising:

a plurality of target sectors that are comprised of a steel plate that is impenetrable to bullets and constructed to withstand an impact from a bullet, wherein the target apparatus remains undamaged after each shot impact;

a plurality of on-target display segments, wherein each target sector is associated with one or more display segments that enable a shooter to determine the target sector hit by the bullet and that are configured so as not to incur damage when directly hit, and wherein the target provides immediate feedback to allow the shooter to improve;

wherein the impact of the bullet on the target creates an impact shock wave with a speed, wherein the target has a non-impact side, further comprising a dampening material coupled to the non-impact side of the target surface to slow down the impact shock wave and allow iterative scanning by sensors configured to locate the impact of the bullet on the target; and at least one sensor coupled to at least one of said plurality of target sectors; receiving an impact of a bullet on said target;

detecting said impact using said at least one sensor;

determining which sector of said plurality of target sectors received said impact using a controller coupled to said at least one sensor, wherein the controller has an iteration speed, and wherein the speed of the impact shock wave is greater than the iteration speed of the controller;

setting a logical indicator indicative of which of said determined target sectors received said impact, the value of said logical indicator set depending on said selected operating mode; and asserting at least one display segment of said plurality of on-target display segments, wherein said asserted display segment operates based on the value of said logical indicator.

20. The method of claim 19 further comprising de-asserting said at least one display segment after a configurable period of time following said impact.

21. The method of claim 19 further comprising displaying a count-down representation of a time remaining for detecting said impact in said selected operating mode.

* * * * *